US005395183A

United States Patent [19]

Watkins

[11] Patent Number: 5,395,183

[45] Date of Patent: Mar. 7, 1995

[54] OFFSHORE DRILLING APPARATUS

[75] Inventor: Bruce J. Watkins, Houston, Tex.

[73] Assignee: Dril-Quip, Inc., Houston, Tex.

[21] Appl. No.: 114,733

[22] Filed: Aug. 30, 1993

[51] Int. Cl.[6] ..... E02B 17/00; E21B 7/12

[52] U.S. Cl. ..... 405/195.1; 166/350; 166/359; 175/7; 405/169; 405/166

[58] Field of Search ..... 405/195.1, 167, 166, 405/165, 224, 204, 169–171; 166/350, 359, 367, 96, 75.1; 114/264, 265; 175/5, 7

[56] References Cited

U.S. PATENT DOCUMENTS

| | | | |
|---|---|---|---|
| Re. 26,290 | 10/1967 | Rand . | |
| Re. 27,261 | 12/1971 | Bromell et al. . | |
| 3,319,981 | 6/1967 | Burgess . | |
| 3,359,741 | 12/1967 | Nelson | 166/350 X |
| 3,389,563 | 6/1968 | Postlehaite et al. | 405/166 |
| 3,390,654 | 7/1968 | Bromell et al. | 175/5 X |
| 3,450,421 | 6/1969 | Hartwell | 166/359 X |
| 3,481,294 | 12/1969 | Vincent . | |
| 3,581,506 | 6/1971 | Howard | 405/166 |
| 3,662,823 | 5/1972 | Morman et al. | 166/359 X |
| 3,791,442 | 2/1974 | Watkins | 166/359 X |
| 3,984,990 | 10/1976 | Jones | 405/195.1 |
| 4,039,176 | 8/1977 | Jansen, Jr. . | |
| 4,486,123 | 12/1984 | Koch et al. | 405/166 X |
| 4,646,841 | 3/1987 | Schawann et al. | 166/359 X |
| 4,822,212 | 4/1989 | Hall et al. | 405/224 X |

FOREIGN PATENT DOCUMENTS

| | | |
|---|---|---|
| 1551400 | 8/1979 | United Kingdom . |
| 1590273 | 5/1981 | United Kingdom . |

*Primary Examiner*—Dennis L. Taylor

*Attorney, Agent, or Firm*—Eickenroht, Thompson, Boulware & Feather Vaden

[57] ABSTRACT

There is disclosed an apparatus for use in drilling an offshore well wherein the upper end of a riser is intermittently supported from a floating vessel to permit the lower ends of additional pipe sections to be connected thereto and then lowered through the table for connection at its lower end to an underwater wellhead. The riser is supported from the vessel in such a manner as to absorb the load of the riser as an additional section is landed on its upper end, and then carry the load of the riser as the vessel tilts or rolls without imposing undue bending loads on the riser.

6 Claims, 4 Drawing Sheets

OFFSHORE DRILLING APPARATUS

This invention relates generally to apparatus for use in drilling an offshore well wherein the upper end of a riser is intermittently supported from a floating vessel to permit the lower ends of additional pipe sections to be connected thereto and then lowered through the table for connection at its lower end to an underwater wellhead. More particularly, it relates to improvements in apparatus of this type in which the riser is supported from the vessel by means which not only absorbs its load but also permits the vessel to tilt without imposing excessive bending loads on the riser.

As well-known in the art, when connected to the underwater wellhead, the riser serves as a guide for the drill bit and the drill string from which it is suspended as well as annular conduit about the string through which drilling mud may be returned to the vessel. The riser is made up of pipe sections fifty to seventy-five feet in length and having connections at each end which enable the connection at the upper end of the riser to be supported as the lower end of an additional pipe section is connected thereto. Conventionally, the connection at the upper end is landed on a "spider" or the like comprising a body having a bore therethrough and legs which are movable between alternate positions within the bore to support the connection and then to permit the riser with the additional section to be lowered through it.

Although the riser is usually neutrally buoyant in the water, it is of considerable length and thus may have a mass up to 3 or 4 million pounds. It is therefore necessary to absorb the impact of this load as the connection on the upper end of the additional section is landed on the spider, particularly if the platform is rising at that moment, and then support the load as the additional sections are connected thereto. Since the floating vessel is rolling in an unpredictable manner, it is also necessary to permit the vessel to tilt with respect to the suspended riser in order to avoid imposing unacceptable bending loads on the riser and/or imposing an unbalanced load on the spider.

Hence, it was proposed in U.S. Pat. No. 3,984,990 to support the spider from a series of circumferentially spaced, extendible and retractible hydraulic actuators each connected by gimbals at its opposite ends to a rotary table mounted on the vessel and the body from which the spider is supported, whereby the rotary table is free to tilt with respect to the spider. The body and spider and thus the weight of the riser are supported from the rotary table by hydraulic fluid supplied to the cylinders by accumulators of such size as to not only support the weight of the riser, but also absorb the impact of the load due to the landing of the connection of the additional pipe section on the upper end of the riser.

Not only is the apparatus of the foregoing patent of complex and expensive construction because of the need for multiple actuators having gimbals at each end, but also the limited pressure-responsive areas of the pistons as a whole required the use of hydraulic fluid and the accumulators, which, of course, adds to the complexity and cost as well as the consumption of precious space. Furthermore, it's well-known that hydraulic fluid is a more difficult pressure medium to handle than air or other gas, principally in the maintenance of seals and other parts.

It is therefore the primary object of this invention to provide apparatus of this type which is of much simpler construction, and thus less expensive to manufacture, and which is able to use air or other gas as a pressure medium, thus not only simplifying its maintenance but also avoiding the need for accumulators.

Another object is to provide such apparatus which is relatively easy to assemble and disassemble.

These and other objects are accomplished, in accordance with the illustrated embodiment of the present invention, by apparatus which includes a housing adapted to be mounted on the vessel and having a generally vertical bore through which the riser may pass and an annular cylinder about the bore, radially inner and outer pistons sealably reciprocable within the cylinder and having respectively outer and inner spherical surfaces formed about a center common to the central axis of the bore of the housing, and a ring having respectively inner and outer spherical surfaces conforming to and sealably slidable within those of the inner and outer pistons so as to provide an annular gimbal. A body mounted on the ring has a bore therethrough above that of the housing bore to receive the riser and means for supporting a connection at the upper end of the riser pipe section, as a connection at the lower end of another section is lowered onto it for connection thereto, and then permit the riser to be lowered further. More particularly, a chamber in the housing cylinder beneath the annular gimbal provided by the ring and pistons is charged with a compressible fluid at a predetermined pressure so as to support the body and thus the riser in such a manner as to absorb the shock of the load of the other pipe section and then support the load of the riser as the vessel tilts with respect to the riser.

As illustrated, the housing is mounted on the rotary table of the vessel having a bore aligned with that of the housing. Also, the body mounted on the housing includes a spider having legs to support the riser connection, as in the case of U.S. Pat. No. 3,984,990.

As will be appreciated, the apparatus is of much simpler and thus less expensive construction than that of the prior patent in that it requires only one actuator and gimbal versus multiple actuators each requiring a pair of gimbals. Furthermore, the considerably larger pressure-responsive area of the annular gimbal enables the use of air or other compressible fluid which is simply supplied to one end of the annular cylinder at the pressure necessary to accommodate the weight and shock loads of the riser.

In the preferred and illustrated embodiment of the invention, one of the pistons comprises first and second parts which are separated along a plane passing through the center, and the ring comprises a main portion and a secondary portion which are also separated along a first plane passing through said center as well as along a second plane perpendicular to the first plane. More particularly, the portions of the one piston are releasably connected together, and the parts of the one piston are releasably connected together, whereby, with the axes of the ring and pistons aligned, a portion of the ring and one part of the one piston may, when disconnected from the other portion and part, respectively, be moved together into or out of assembled positions with respect to one another.

As shown, each of the parts of the one piston carries a seal ring for sealably engaging about the spherical surface of the ring opposite thereto, and the other piston carries seal rings for sealably engaging the other spherical surface on the main and secondary portions of the ring to insure that no seal ring crosses the separation between them. As illustrated, the one piston is the outer piston.

In the drawings, wherein like reference characters are used throughout to designate like parts:

Figure 2:
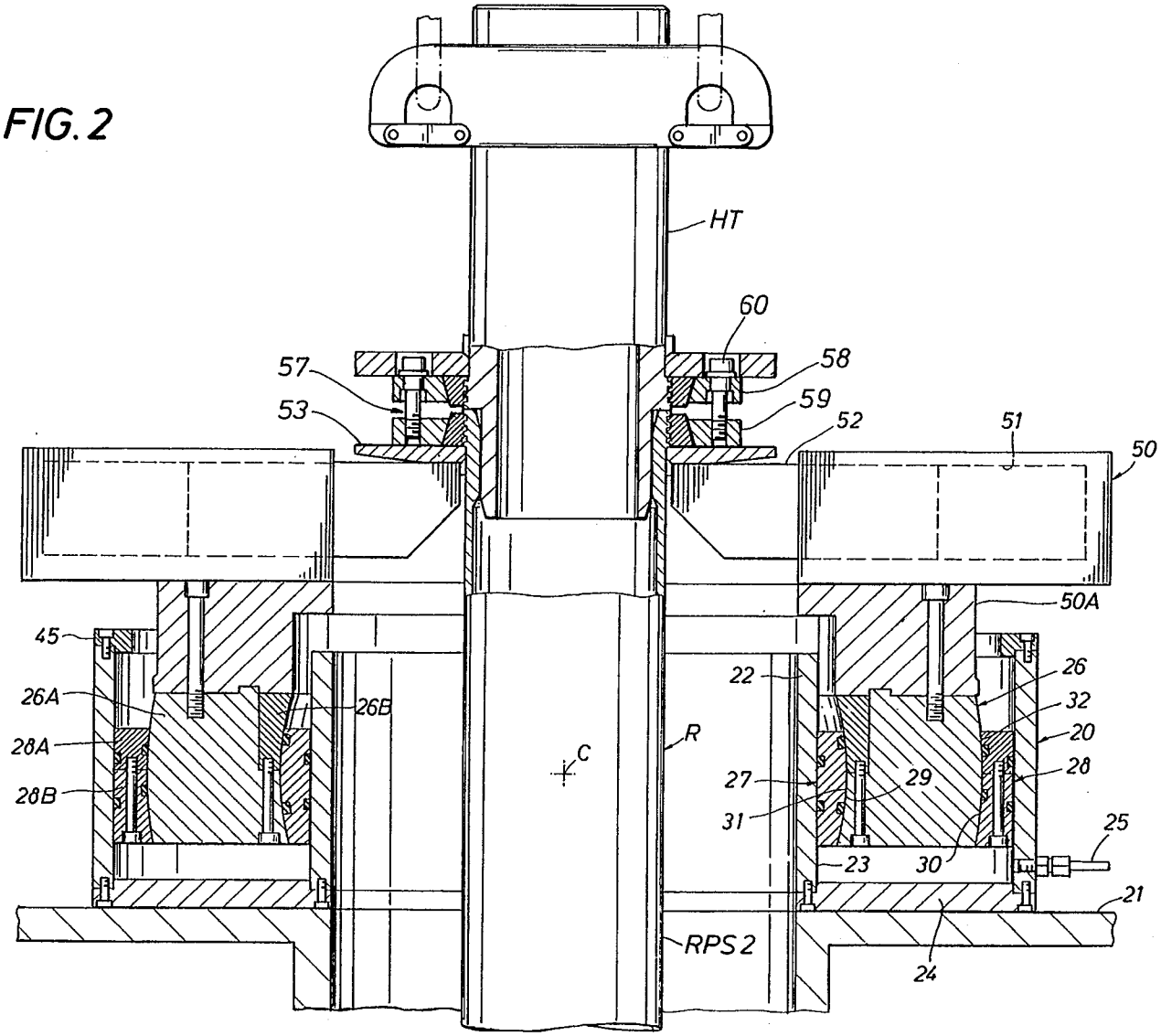
FIG. 2 is a view similar to FIG. 1 but showing the upper end of the additional riser pipe section lowered onto the spider, following connection of its lower end to the upper end of the riser shown in FIG. 1, thus causing the annular gimbal to be lowered as the air is compressed in the lower chamber of the cylinder of the housing.
Figure 3:
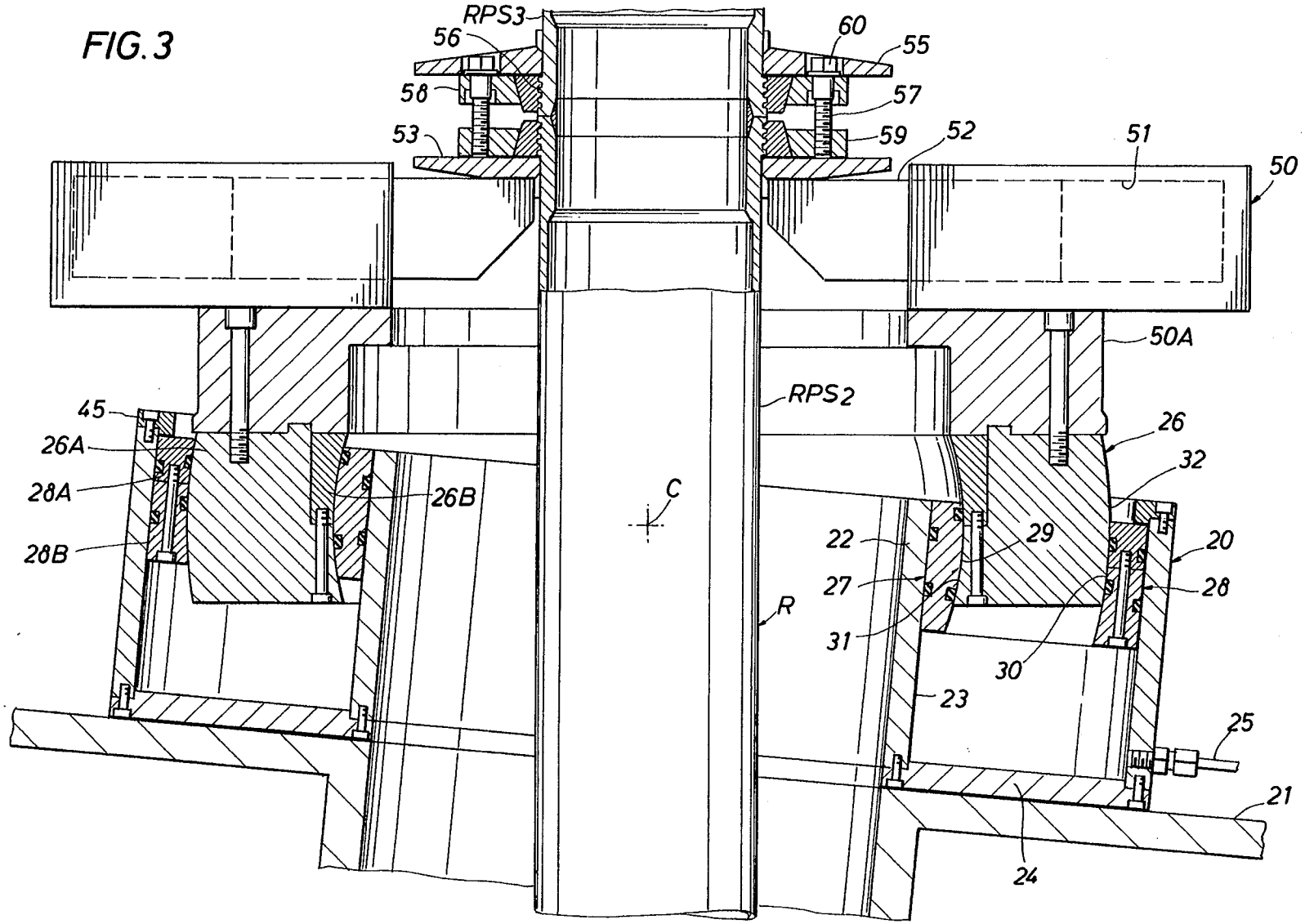
Figure 4:
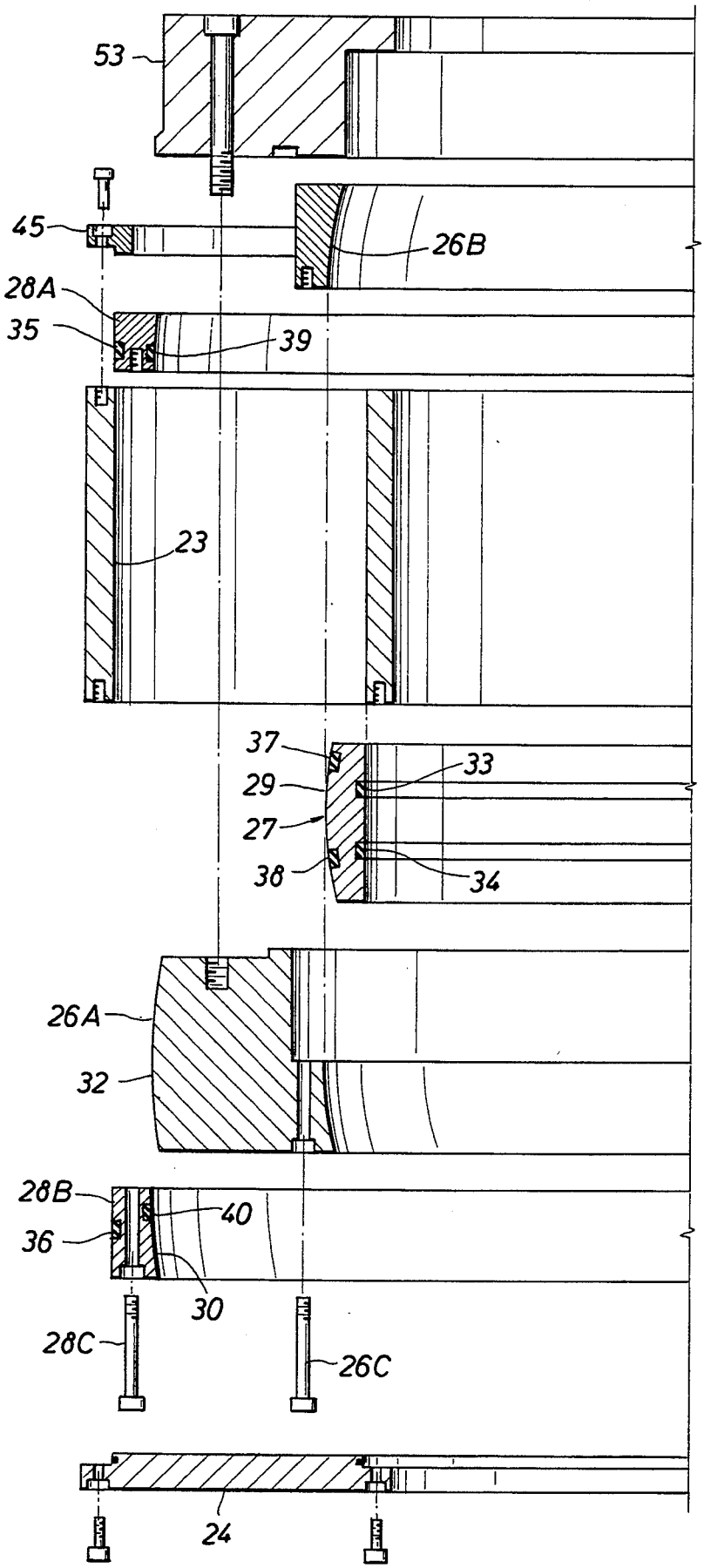

FIG. 3 is a view similar to FIG. 2, but upon raising of the gimbal due to expansion of the air and connection of the lower end of still another pipe section to the upper end of the riser shown in FIG. 2 and with the rotary table tilted to accommodate roll of the floating vessel; and FIG. 4 is an exploded half-sectional view of the annular gimbal and housing showing the pistons and ring separated from one another and removed from within the cylinder of the housing.

Figure 1:
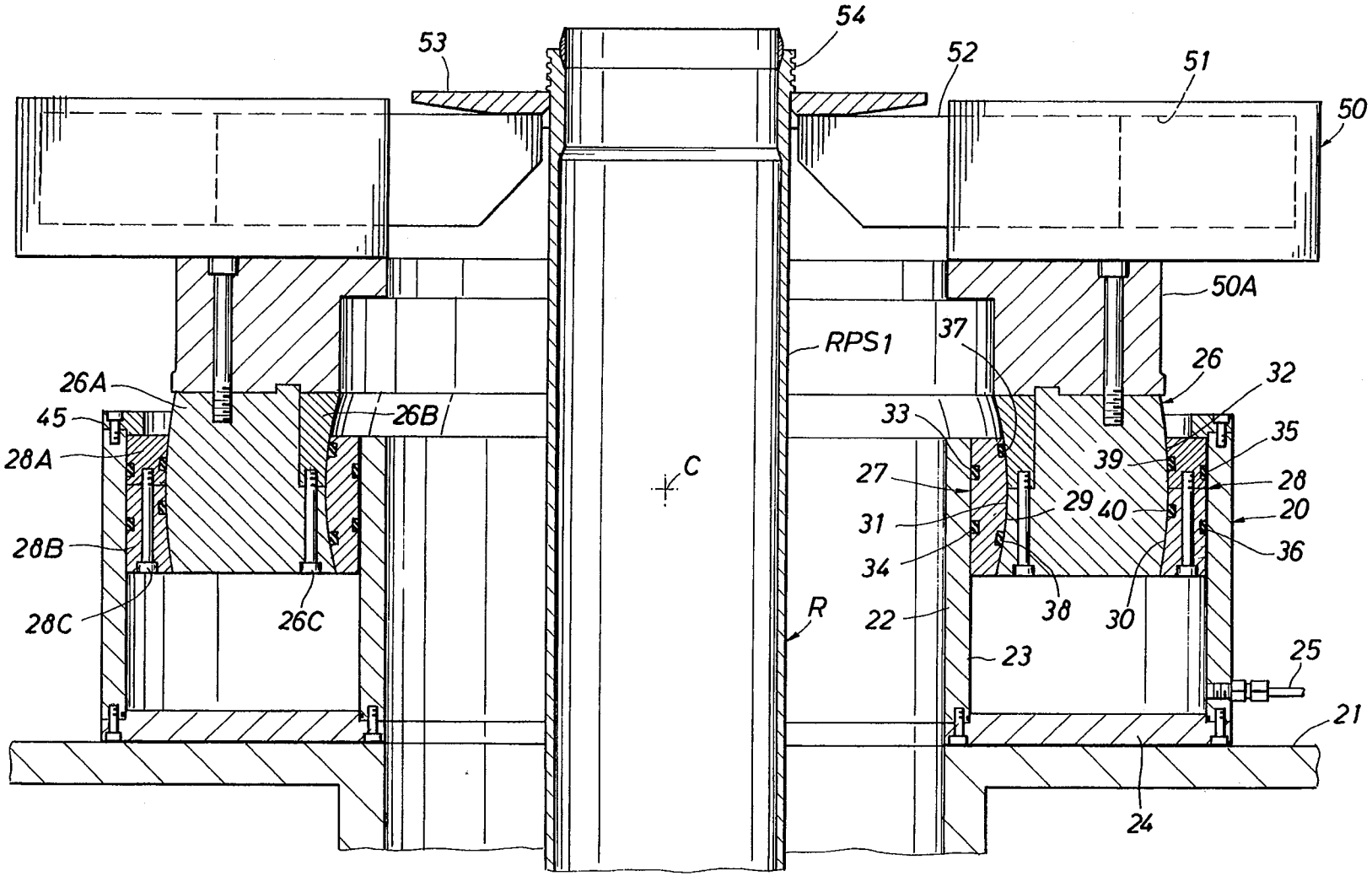
FIG. 1 is a vertical sectional view of apparatus constructed in accordance with the present invention with the upper end of a riser supported therefrom in position to have the lower end of an additional riser pipe section connected thereto.

With reference now to the details of the above described drawings, the apparatus is shown to include a housing 20 mounted on a rotary table 21 supported beneath the deck of a floating drilling vessel. The housing has a vertical bore 22 aligned with the bore of the rotary table and through which a riser R extends. As shown in FIGS. 1 and 2, with the vessel in a level position, the axes of the riser and bore 22 coincide.

The housing 20 has an annular cylinder 23 formed therein concentrically of its bore and adapted to be closed at its lower end by an annular plate 24 which seats upon and is adapted to be connected in any suitable manner to the rotary table 21 to align the bores of the housing and rotary table. A hose or other conduit 25 connects with the lower end of the cylinder 23 above the annular plate 24.

The apparatus further includes inner and outer pistons 27 and 28 which are reciprocable within the inner and outer diameters of the cylinder and a gimbal ring 26 which is received between the pistons for revolving within the pistons about a center C common to the axis of the bore of the housing. More particularly, the gimbal ring is captured between the pistons and reciprocates with them within the cylinder 23 to form an annular gimbal which is supported within the housing by means of gas introduced through the conduit 25 at a desired pressure into the at the lower end of the cylinder.

Thus, the inner and outer pistons have, respectively, outer and inner spherical surfaces 29 and 30 which are formed about the center C, and the ring has, respectively, inner and outer spherical surfaces 31 and 32 which are complementary to those of the pistons to enable the gimbal ring to revolve in the manner described, as is shown in FIG. 3, when the vessel tilts with respect to the riser. The piston 27 has seal rings 33 and 34 about its inner diameter for sealably sliding within cylinder 23, and the piston 28 has seal rings 35 and 36 about its outer diameter for sealably sliding within the cylinder. More particularly, the piston 27 has seal rings 37 and 38 carried about its outer diameter sealably sliding along the spherical surface 31 on the inner side of the gimbal ring 26, and the piston 28 has seal rings 39 and 40 carried on its inner diameter for sealably sliding along the outer spherical surface 32 of the gimbal ring. Thus, the annular gimbal sealably closes the upper end of the pressure chamber.

The apparatus further includes a "spider" mounted above the gimbal ring 26 to support a connection on the upper end of the riser R in position to receive the lower end of an additional riser pipe section for connection thereto. As indicated diagrammatically, the spider includes a body 50 mounted on the ring and arms 52 having outer ends received within the body to enable them to be moved in any suitable manner between inner positions to support the riser and outer pistons to permit the riser to be lowered upon connection of an additional riser pipe section thereto. This means of supporting the riser pipe connections may be of conventional construction known in the art and need not be illustrated in this patent application. In any case, the body 50 is mounted to the upper end of the gimbal ring 26 by means of an intermediate spacer 50A which is bolted to the ring and which may be selected to provide the desired vertical spacing between the upper end of the gimbal ring and the support arms.

As shown in FIG. 1, the connector on the upper end of the riser R includes a plate 53 carried beneath threads 54 about the upper end of the uppermost pipe section $RPS_1$ of the riser and adapted to rest on the spider arms 52 when the arms are in their inner positions. This connector on the upper end of the riser is adapted to be connected to the lower end of an additional riser pipe section $RPS_2$, which, following such connection, is lowered to permit its upper end to be connected to the lower end of a further additional riser pipe section $RPS_3$, as shown in FIG. 3.

The connector at the lower end of $RPS_2$ is similar to that shown in FIG. 3 at the lower end of $RPS_3$, and thus includes a plate 55 above threads about the lower end of the section. These connectors at the adjacent ends of the riser pipe sections are adapted to be joined by means of a coupling 57 having upper and lower plates 58 and 59 adapted to move the threaded inner ends of split wedges 60 and 61 into engagement with the teeth 54 and 56 as the plates are moved apart by means of the bolts 60.

Upon connection of the lower end of $RPS_2$ to the upper end of $RPS_1$, the legs 52 of the spider are withdrawn to permit $RPS_2$ to be lowered with the remainder of the riser R. For this purpose, a handling tool HT is releasably connected to the upper end of $RPS_2$ by a connector which, as shown in FIG. 2, is similar to that on the lower end of each riser pipe section.

The legs of the spider are then moved inwardly to the position of FIG. 2 to support the connector on the upper end of $RPS_2$ and thus the entire riser R as it continues to be lowered. The shock or impact of the weight of the riser is cushioned by the gas contained in the pressure chamber of the housing 20 as the annular gimbal moves downwardly, as shown in FIG. 2.

Thus, as previously described, the downward movement of the riser, whose mass at this point may be 3 or 4 million pounds of mass, is decelerated by compression of the gas in the chamber. For example, with an annular gimbal having a pressure-responsive area of approximately 5,000 square inches, gas at 100 psi would support approximately 500,000 pounds of dead load. On the other hand, in order to decelerate the impact of the mass of the riser, the air may be compressed up to 1,000 psi. Obviously, when the mass has been decelerated, the gas will expand to cause it to rise and, in fact, approach the original position of FIG. 1.

When this shock has been absorbed, the gas will expand to raise the annular gimbal, as shown in FIG. 3. The handling tool HT may then be disconnected and raised, and the lower end of the additional riser pipe section $RPS_3$ connected to the upper end of riser pipe section $RPS_2$, again as shown in FIG. 3. This process may, of course, be repeated as still further riser pipe sections are added.

As previously described, when the vessel rolls, the gimbal ring will revolve within the pistons 27 and 28 to permit the body 50 and its support arms 52 to revolve in such a way as to permit the riser pipe to remain vertical and thus maintain an even loading of the riser pipe on the arms. The gimbal ring is, of course, free to revolve to different positions between the pistons as the vessel rolls from one side to another or assumes a level position. All of this occurs, of course, as the annular gimbal is supported by the air in the pressure cylinder.

As shown, a retainer 45 is bolted to the upper end of the outer wall of the housing in position to hold the gimbal in the cylinder by limiting its upward movement. The retainer may, of course, be removed to permit the pistons and gimbal ring to be inserted or removed as a unit.

As previously described, one of the pistons is made of separate parts and the gimbal ring is made of main and auxiliary portions which are releasably connected to one another in such a way as to permit assembly and disassembly of the annular gimbal. For this purpose, the outer piston 28 is made up of upper and lower parts 28A and 28B, respectively, which are separated along a plane passing through the aforementioned center C about which the gimbal ring revolves. More particularly, the separate parts of the outer piston are releasably connected by bolts 28C with the upper seal rings 33 and 39 being carried on the upper part 28A and the lower rings 36 and 40 being carried by the lower part 28B.

The gimbal ring 26 includes a main portion 26A and an auxiliary portion 26B which are releasably connected to one another by means of bolts 26C. More particularly, these portions are separated from one another along a first plane which also passes through the center C of revolution of the gimbal ring, as well as along a second plane which is perpendicular to the first plane.

Thus, as best illustrated in FIG. 4, upon separation of the parts 28A and 28B from one another, and separation of the portions 26A and 26B from one another, the parts of the piston 28 may be moved over the opposite ends of the outer spherical surface of the=gimbal ring portion 26A and then connected to one another by bolts 28C, while the inner piston 27 may be moved into position adjacent the lower portion of the inner spherical surface of the gimbal ring portion 26A; and the auxiliary portion 26B thereof then moved into the space between the upper end of the piston and the adjacent planar face of the portion 26A, and the portions then connected to one another by bolts 26C.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For use in drilling an offshore well wherein the upper end of a riser is intermittently supported from a floating vessel to permit the lower ends of additional pipe sections to be connected thereto an apparatus comprising a housing adapted to be mounted on the vessel and having a generally vertical bore through which the riser may pass and an annular cylinder about the bore, radially inner and outer pistons sealably reciprocable within the cylinder and having respectively outer and inner spherical surfaces formed about a center common to the central axis of the bore of the housing, a ring having respectively inner and outer spherical surfaces conforming to and sealably slidable within those of the inner and outer pistons, means mounted on the ring for supporting a connection on the upper end of the riser, as the lower end of another pipe section is connected thereto, and then permit the riser to be lowered further, and means by which a chamber in the housing cylinder beneath the ring and pistons may be charged with a compressible fluid at a predetermined pressure so as to support the riser as the vessel tilts with respect to the riser.

2. Apparatus of the character defined in claim 1, wherein said supporting means comprises a body mounted on the ring and having legs movable between inner positions to support the riser connection and outer positions to permit the connection to be lowered within the riser through the bore of the body.

3. Apparatus of the character defined in claim 1, wherein one of the pistons comprises first and second parts which are separated along a plane passing through said center, and the ring comprises a main portion and a secondary portion which are also separated along a first plane passing through said center as well as along a second plane perpendicular to said first plane, and including means releasably connecting the portions of the one piston to one another, and means releasably connecting the parts of the ring to one another, whereby, with the axes of the ring and pistons aligned, a portion of the ring and a part of the one piston may, when disconnected from the other part and portion, respectively, be moved together into or out of the cylinder for assembly or disassembly.

4. Apparatus of the character defined in claim 3, wherein each of the parts of the one piston carries a seal ring for sealably engaging about the spherical surface of the ring opposite thereto, and the other piston carries seal rings for sealably engaging the other spherical surface on the main and secondary portions of the ring.

5. Apparatus of the character defined in claim 4, wherein said one piston is the outer piston.

6. Apparatus of the character defined in claim 1, wherein the floating vessel has a rotary table on which the housing is mounted.

* * * * *

UNITED STATES PATENT AND TRADEMARK OFFICE

CERTIFICATE OF CORRECTION

PATENT NO. : 5,395,183

DATED : March 7, 1995

INVENTOR(S) : Bruce J. Watkins

It is certified that error appears in the above-indentified patent and that said Letters Patent is hereby corrected as shown below:

In Claim 3:

Col. 6, line 55, change "portions" to -- parts --.

Col. 6, line 57, change "parts" to -- portions --.

Signed and Sealed this

Seventeenth Day of September, 1996

Bruce Lehman

*Attest:*

BRUCE LEHMAN

*Attesting Officer*

*Commissioner of Patents and Trademarks*